US007585146B2

(12) United States Patent
Widmer et al.

(10) Patent No.: US 7,585,146 B2
(45) Date of Patent: Sep. 8, 2009

(54) STACKING DEVICE HAVING A SYSTEM OF CIRCULATING SUPPORTS

(75) Inventors: Josef Widmer, Wikon (CH); Roland Hofer, Murgenthal (CH); Benno Arnold, Uffikon (CH)

(73) Assignee: Hunkeler AG, Wikon (CH)

( * ) Notice: Subject to any disclaimer, the term of this patent is extended or adjusted under 35 U.S.C. 154(b) by 162 days.

(21) Appl. No.: 11/122,088

(22) Filed: May 5, 2005

(65) Prior Publication Data

US 2005/0269765 A1 Dec. 8, 2005

(30) Foreign Application Priority Data

May 5, 2004 (EP) ..... 04010658

(51) Int. Cl.
*B65H 29/26* (2006.01)
*B65H 31/30* (2006.01)
*B65G 17/00* (2006.01)

(52) U.S. Cl. ..... 414/793.9; 414/790.4; 414/790.8; 414/793.5; 414/793.8; 198/793; 271/190

(58) Field of Classification Search ..... 414/794.1, 414/793.5, 791.6, 331.02–331.05; 198/469.1, 198/779, 793, 798–799; 271/190, 201
See application file for complete search history.

(56) References Cited

U.S. PATENT DOCUMENTS 3,807,553 A * 4/1974 Billett et al. ..... 209/565
4,055,257 A 10/1977 Krebs
5,803,706 A * 9/1998 Achelpohl ..... 414/794.4
5,984,620 A * 11/1999 Heston ..... 414/791.6
2001/0023812 A1 * 9/2001 Kelley ..... 198/339.1
2004/0050657 A1 * 3/2004 Langenegger et al. .... 198/347.1
2004/0216985 A1 * 11/2004 Nishihara et al. ..... 198/469.1

FOREIGN PATENT DOCUMENTS

DE 39 28 028 A1 2/1991
EP 0 770 570 A2 5/1997
WO WO 02/22482 A1 3/2002

* cited by examiner

*Primary Examiner*—Gregory W Adams
(74) *Attorney, Agent, or Firm*—Oliff & Berridge, PLC

(57) ABSTRACT

A device for forming stacks of sheet products, in particular of paper products, may include the paper products being supplied in an input stream by a feed conveyor to a transfer section. The device may also include at least two set-down tables each including a set-down surface for receiving stacks of the supplied paper products. The set-down tables may move along a circuit-like table-circulating path and may be flexible at least in some segments to conform to shapes of curvatures located in at least some parts and subregions of the table-circulating path. As a result, it is possible for the set-down tables to be guided into the curvatures with a leading front side edge of each of the set-down tables being a leading edge in a circulating direction of the set-down tables. The stacks of stacked paper products may then be transported away from a delivery section by a removal conveyor.

13 Claims, 4 Drawing Sheets

STACKING DEVICE HAVING A SYSTEM OF CIRCULATING SUPPORTS

BACKGROUND

The invention relates to a device for forming stacks of sheet-like products, in particular of paper products, and to a method for stacking products.

A device of this type is disclosed, for example, in WO-A-02/22482. In the case of the device described therein, paper products coming from a high-speed printer are supplied in a continuous stream along a conveying direction to a transfer section and are set down on a horizontally oriented, rigid set-down table. The set-down table is lowered vertically during the stacking operation and is filled with the paper products until a stack has a required number of the paper products. The set-down table is then vertically lowered to a delivery section.

In the delivery section, a band conveyor reaches through a grid-like set-down table and transports the stack of paper products away. The set-down table, which is now empty, is moved back horizontally by a further band conveyor, counter to the conveying direction, and by more than a length of the set-down table. Then, the set-down table is transported horizontally upward by a further band conveyor into a holding-ready position.

As soon as the set-down table is required for receiving a new stack, a further band conveyor conveys the set-down table horizontally, parallel to the conveying direction, and into the delivery section. For an interruption-free formation of stacks, at least one further set-down table is guided in each case horizontally and vertically in the circuit-like table-circulating path.

EP-B-0737640 discloses a method and a device for inserting an auxiliary stack picking-up means in a sheet delivery unit of printing machines. In this case, with an uninterrupted supply of further sheets (paper products), an auxiliary stack frame is inserted over a main stack in a running direction of the sheets and synchronously with the movement of a paper product to be set down. The main stack can subsequently be removed, and then the auxiliary stack picking-up means withdrawn, so that the paper products can again be set down on a pallet (set-down table) of the main stack. As an alternative, the auxiliary stack picking-up means receives the new main stack. When the main stack, which has now come to rest on the auxiliary stack picking-up means, is transported away again, a further auxiliary stack picking-up means has to be brought up.

SUMMARY

In all of the known stacking devices, the extent of the table-circulating path in a feeding direction of a stream of paper products is at least double the length of a set-down table. The large constructional form of the device that is required in these cases results from the shape of the table-circulating path, the shape being composed of rectilinear vertical and horizontal sections. In addition, the associated transportation of the set-down tables perpendicularly with respect to a set-down surface for the paper products restricts the guiding speed of the set-down tables in the table-circulating path.

An object of exemplary embodiments of the present invention is to provide a method and a device which make it possible to stack products, in particular paper products, in a variable number, and horizontally one above another, and with little outlay and space being required to hold the stacks ready in a rapid temporal sequence for devices arranged downstream.

Exemplary embodiments of a device for forming stacks of sheet-like products, in particular of paper products, may include the paper products supplied in an input stream by a feed conveyor to a transfer section. The device may include at least two set-down tables with at least one set-down surface in each case for stacks of supplied products. The set-down tables may be moved along a circuit-like table-circulating path, an imaginary connecting section running in a circulating direction between positions of a surface central point of the set-down surface during a circulating cycle, and may be flexible at least in some segments of the set-down tables. As a result, the set-down tables may be capable of conforming to shape of curvatures of the table-circulating path, the curvatures being located at least in some parts and subregions of the table-circulating path. An output stream of paper products stacked into stacks may then be removed from a delivery section by a removal conveyor.

Owing to the flexible set-down tables adapted to the curvatures of the table-circulating path, it is possible to construct the table-circulating path to be very confined and space-saving, and to give the overall device a very compact constructional form. At the same time, air resistance may be substantially reduced with a more stable transporting position when the set-down tables are moved with a leading front side edge leading in a circulating direction of the table circulating path. As a result, the set-down tables may now be guided in the table-circulating path at a higher speeds and in shorter circulating times.

These and other features are described in or are apparent from the following detailed description.

BRIEF DESCRIPTION OF THE DRAWINGS

Various exemplary details are described herein, with reference to the following figures, wherein.

DETAILED DESCRIPTION OF EMBODIMENTS

Figure 1:
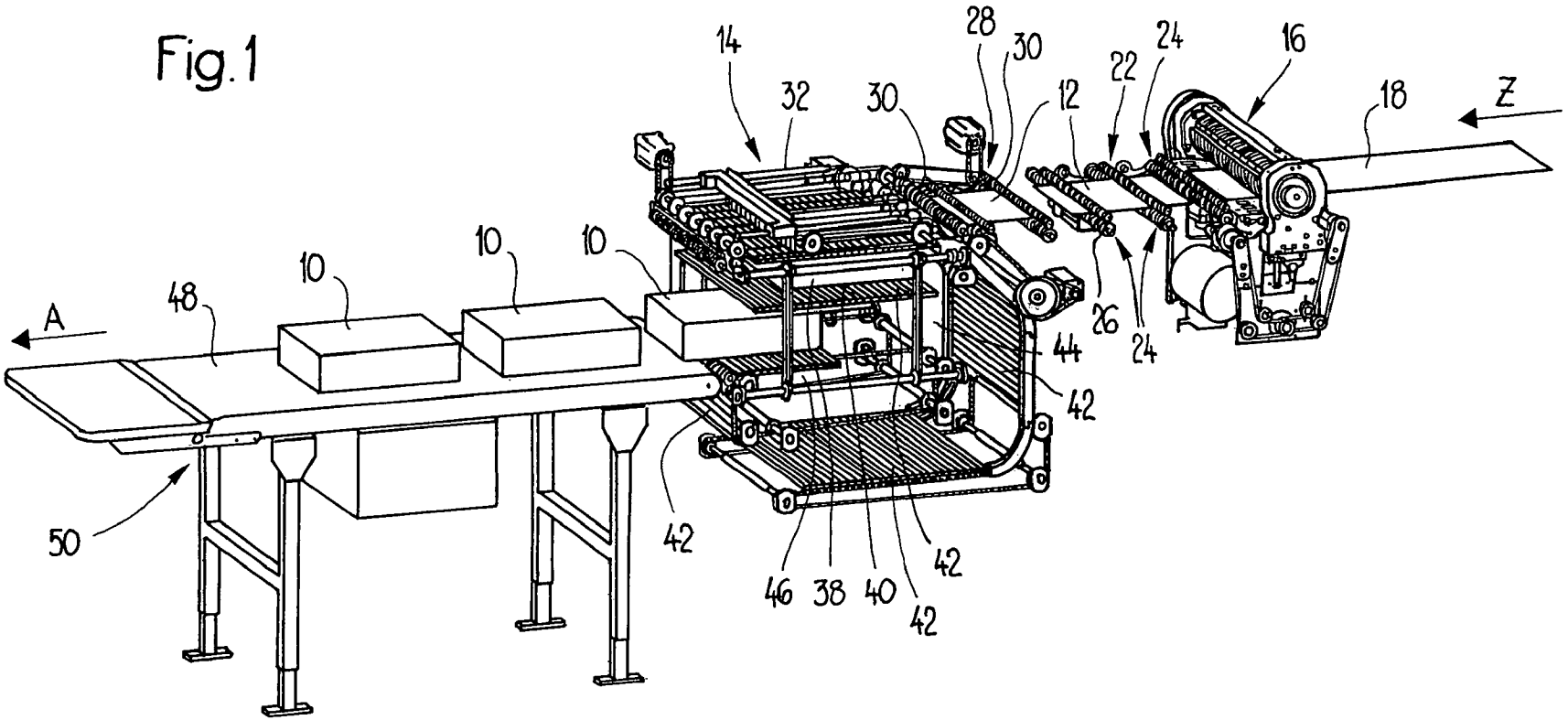
FIG. 1 is a perspective schematic view of an exemplary device for stacking paper products that are arranged downstream of a rotational cutting device.

FIG. 1 is a perspective schematic view of an exemplary device for forming stacks of sheet-like products, in particular of paper products 12, in one exemplary embodiment of a paper stacker 14.

The paper stacker 14 is arranged downstream of a rotational cutting device 16 of a known type. The rotational cutting device 16 cuts a continuous paper web 18 into individual sheets, which form an input stream of paper products 12 and are guided to the paper stacker 14 by an intermediate conveyor 22 including sheet feed rollers 24, 26. The intermediate conveyor 22, shown in FIG. 1, transports the paper products 12 in a feeding direction Z to a feed conveyor 28.

The feed conveyor 28 takes over the paper products 12 and conveys them on to a transfer section 32.

After reaching a predetermined set-down position 38, the paper products 12, which have been newly conveyed, drop downward due to gravitational force causing the paper products 12 to rest on a still empty set-down surface 40 of a set-down table 42 or on a stack 10 of paper products 12 that is already present on the set-down table 42. The stack 10, which is increased by each further conveyed paper product 12, is in each case lowered successively together with the set-down table 42 located in a stacking section 44. The stack 10 is lowered such that an upper surface of the uppermost paper product 12, which is located on the stack 10 to be loaded, substantially coincides with an original height of the empty set-down surface 40 of the set-down table 42. This lowering takes place until the stack 10 has a desired number of the paper products 12 lying one above another.

The set-down table 42 carrying the stack 10 is then lowered as far as a lower level of a delivery section 46. The stack 10, without the set-down table 42, is then removed into an output stream by being pushed onto a removal conveyor 48, which is in the form of a band conveyor. The removal conveyor 48, which is mounted on a delivery table 50, transports the stack 10 on to a subsequent destination.

The circuit-like guidance of the set-down tables 42 until subsequent loading with paper products 12 will now be described in detail in conjunction with FIG. 2.

Figure 2:
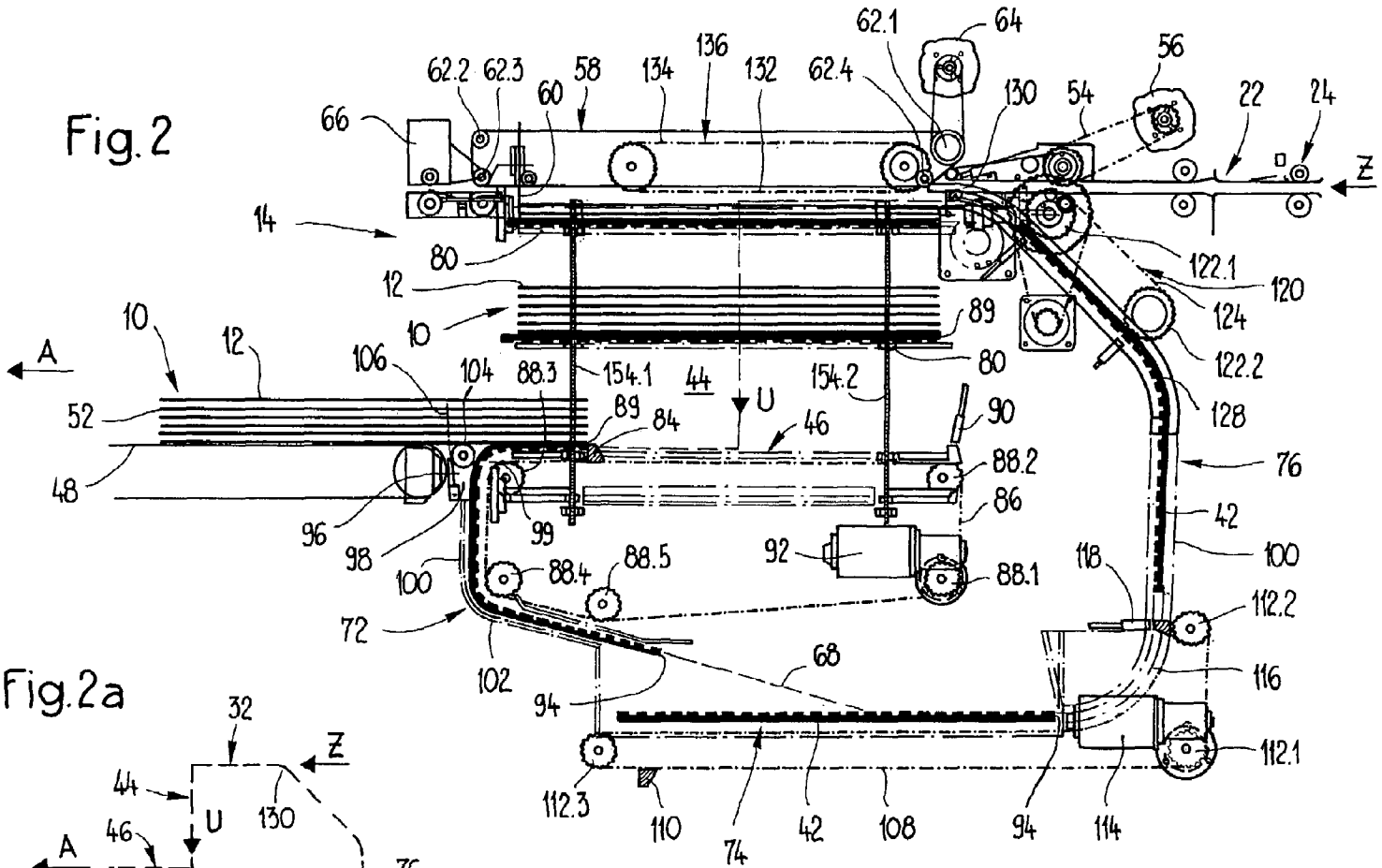
FIG. 2 is a side schematic view of the exemplary device shown in FIG. 1 for stacking paper products.

FIG. 2 is a side schematic view of the paper stacker 14 according to the exemplary embodiment. For clarity reasons, an illustration of support and housing elements of the paper stacker 14 has been omitted. As already mentioned in conjunction with the overview illustration in FIG. 1, the paper products 12 are brought by the feed conveyor 28 to the transfer section 32 at a conveying speed of approximately 50 m/min to approximately 150 m/min. In the conveying process, the sheet-like paper products 12 take up a substantially horizontal position and are guided with a leading front side edge 52 of each of the paper products 12 leading in the feeding direction Z and in a circulating direction of the table-circulating path 68. As a result, a stable transporting position with little air resistance and a high conveying speed may be provided for the paper products 12. The feed conveyor 28 may alternatively be replaced by different embodiments of conveyors, for example, a band conveyor. The conveying speed may also be adapted to individual requirements for specified devices, in particular, transporting, cutting or printing devices that may be used in conjunction with the paper products.

Pairs of rollers 30 of the feed conveyor 28 are driven by an associated electric motor 56 via a toothed-belt drive 54. The electric motor 56 may be driven electrically in such a manner that the paper products 12 are accelerated or braked in the feeding direction Z, and the conveying speed of the paper products 12 is therefore influenced, for example, as a function of a lowering speed of the set-down tables 42 or of a drawing-in speed of the set-down tables 42 into the transfer section 32.

In order to draw the paper products 12 into the transfer section 32, the paper products 12 are taken from the feed conveyor 28 by a belt conveyor 58 and transported to the set-down position 38. In this drawing process, the paper products 12 may be actively braked by the belt conveyor 58 and/or may be passively stopped in the set-down position 38 by means of an end stop 60. In the exemplary embodiment shown in FIG. 2, both measures are used in order to obtain a precise set-down position 38 with gentle treatment of the leading front side edge 52 of each of the paper products 12. The belt conveyor 58 has four mutually parallel axles 62.1, 62.2, 62.3, 62.4 fitted with pulleys. The end sides of the axles 62.1, 62.2, 62.3, 62.4 form a substantially rectangular arrangement. The belt conveyor 58 is driven by an associated electric motor 64 via the axle 62.1.

As an alternative, the paper products 12 may also be transported further by the belt conveyor 58 to an additional unit 66, shown in FIG. 2, for example a continuing conveyor.

The set-down tables 42 are moved in a table-circulating path 68, which is an imaginary connecting section running in a circulating direction U between positions of the surface central point of a set-down surface 40 during a circulating cycle. The table-circulating path 68 is illustrated in FIG. 2 and FIG. 2*a* by means of a dashed line and runs parallel to the plane of the illustration.

The set-down tables 42 are flexible at some rod-shaped or rib-shaped segments. As a result, a shape of each of the set-down tables 42 may conform to curvatures of the table-circulating path 68, the curvatures being located at least in some parts and subregions of the table-circulating path. The flexibility of the set-down tables 42 is sign-dependent and direction-dependent, so that only positive curvatures of the set-down tables 42 around the table-circulating path 68 are possible for the set-down surfaces 40 that are convexly curved with regard to the table-circulating path 68. On the other hand, curvatures of the circulating set-down tables 42 also occur only in planes that lie parallel to the plane in which the table-circulating path 68 runs.

Perpendicularly, with respect to the plane of the table-circulating path 68, the set-down tables 42 are rigid in their circulation. In this manner, the set-down tables 42 act as lateral supports having sufficient stability to support a stack 10 of the paper products 12. The feature of the direction-dependent flexibility of the set-down tables 42 is achieved by joining together flats that are rigid along longitudinal axes. When the flats are joined together in relation to one another, the flats are pivotable with regard to the longitudinal axes. As an alternative, any set-down tables 42 having the capability of adapting to positive and negative curvatures about the table-circulating path 68 are also conceivable.

Figure 2A:
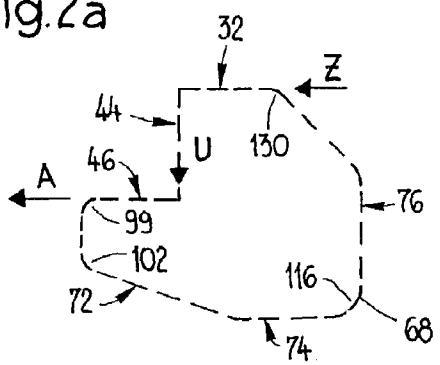
FIG. 2*a* is an abstracted, schematic view of a table-circulating path of the set-down tables.

In addition to the table-circulating path 68 shown in FIG. 2 and FIG. 2*a*, an alternative arrangement is possible. For example, the table-circulating path 68 may be rotated by, for example, 90° in relation to the feeding direction Z in order to run perpendicularly with respect to the plane of the illustration in FIG. 2.

As shown in the abstracted, side schematic view in FIG. 2*a*, the table-circulating path 68 may include portions of the transfer section 32, the stacking section 44 and the delivery section 46, a return section 72, a table store 74 and a holding-ready section 76. The functions of the sections 32, 44, 46, 72, 74, 76 of the table-circulating path 68 are later described in detail in conjunction with FIGS. 5*a*-5*d*.

As shown in FIG. 2, the lowering of the horizontally oriented set-down table 42 in the stacking section 44, which extends from the transfer section 32 to the delivery section 46, is brought about via side mounts 80, which engage laterally on both sides of the set-down table 42, on circulating table-carrying bands 82. A detailed description of the interacting elements is later described in conjunction with FIG. 4.

As shown in FIG. 2, in the delivery section 46, the movement of the set-down tables 42 takes place in a removing direction A running substantially parallel to the feeding direction Z. The set-down table 42 is pushed forward by a cam strip 84 which is mounted on a pair of roller chains 86, is clamped between a driving chain wheel 88.1 and four driven chain wheels 88.2, 88.3, 88.4, 88.5, and protrudes outward radially from the pair of roller chains 86. In the delivery process, the circulating cam strip 84 presses against a trailing end side 89, e.g., at the rear as seen in the circulating direction U, of the set-down table 42. As a result, the cam strip 84 moves the set-down table 42 forward in the circulating direction U. The axles of the chain wheels 88.1, 88.2, 88.3, 88.4, 88.5 lie parallel to one another, and with respect to their end surfaces, are arranged in a manner substantially defining a rectangle. For every set-down table 42 transported away by the pair of roller chains 86, the cam strip 84 performs a complete circulation, which is monitored by a sensor 90.

The driving chain wheel 88.1, which is fed by a further electric motor 92, accelerates the pair of roller chains 86 gently at an acceleration of less than 2 $m/s^2$ with the effect of treating the stack as gently as possible. This may be achieved by means of a ramp-like electric activation of the electric motor 92. The final speed of the pair of roller chains 86 assumed after the acceleration phase can be set in a variable manner. In order to permit a greater acceleration of the set-down table 42, it is conceivable to bring the stack 10 and the set-down table 42 simultaneously into contact with the cam strip 84 and to accelerate them.

With a front side 94 of the set-down table leading ahead in the circulating U, the set-down table 42 encounters a comb-like guide grid 96. The guide grid 96 has T-shaped grid elements 98, which are oriented parallel to one another in the removing direction A, in order to deflect the horizontally arriving set-down tables 42 vertically downward into the return section 72, and therefore, to effect a curvature 99 in the table-circulating path 68. Only an outer grid element 98 can be seen in FIG. 2.

After the set-down tables 42 experience a substantially right-angled deflection due to their flexibility, the set-down tables 42 initially come to rest against a vertically oriented guide rail 100. After a further curvature 102 in a direction counter to the removing direction A, the guide rail 100 includes a slightly horizontally downward inclination. As a result, the guide rail 100 guides the set-down tables 42 with the front side 94 leading from the return section 72 into a table store 74.

While the set-down tables 42 are deflected downward by the guide grid 96, the stack 10, which is guided on horizontally oriented upper edges 104 of the grid elements 98, continues to move in the removing direction A. The guide grid 96 therefore separates a stream of the paper products 12 and a stream of the set-down tables 42, which have temporarily been guided together in the paper stacker 14.

As soon as the stack 10 protrudes over the guide grid 96 in the removing direction A, the stack 10 is supported by the removal conveyor 48 and is transferred by the latter to a desired destination. The transporting away of the stacks 10 is monitored by means of a further sensor 106 mounted on the guide grid 96. The speed of the removal conveyor 48 is variable and is preferably between 2 m/min and 20 m/min.

The table store 74 can receive a variable number of set-down tables 42, for example, five set-down tables 42, can temporarily store the set-down tables 42, and can sequentially release the set-down tables 42 for further circulation. The set-down tables 42 come to rest horizontally, one above another, in the table store 74. A further pair of roller chains 108 circulating below the table store 74 is equipped with a further cam strip 110 protruding away from the pair of roller chains 108. The pair of roller chains 108 runs parallel to the set-down tables 42 between a further driving chain wheel 112.1 and two further driven chain wheels 112.2, 112.3, axles of which are oriented parallel to one another. The driving chain wheel 112.1 is driven by a further electric motor 114. In order to transport away a set-down table 42 from the table store 74, the cam strip 110 presses against the trailing end side 89 of the set-down table 42. As a result, the cam strip 110 moves the set-down table 42 forward in the circulating direction U. The set-down table 42 that is inserted into the table store 74, in each case, is also released again for further circulation.

In the circulating direction U, the table store 74 is followed by the holding-ready section 76 that includes a further curvature 116, which guides the set-down table upward in the vertical direction. For this purpose, the cam strip 110 pushes the set-down table 42, with the front side 94 leading, to a height of a further sensor 118 until the set-down table 42 is taken over by a table-holding-ready drive 120. In the holding-ready section 76, the set-down surfaces 40 are guided substantially at right angles to the position of the set-down surfaces 40 in the stacking section 44. This structure makes it possible to reduce a dimension of the table-circulating path 68 in the feeding direction Z. Therefore, this structure provides a very compact construction of the paper stacker 14.

The table-holding-ready drive 120 has a toothed belt 124 that circulates between a driving wheel 122.1 and a driven wheel 122.2 and is fitted on both sides with teeth. The toothed belt 124 interacts with engagement structures 128, which are formed on an upper side of the set-down tables 42 on both sides in lateral edge regions 126.1, 126.2 of the set-down tables 42 as shown in FIG. 4, in such a manner that the teeth of the toothed belt 124 engage in elevations and depressions of the edge regions 126.1, 126.2.

Figure 4:
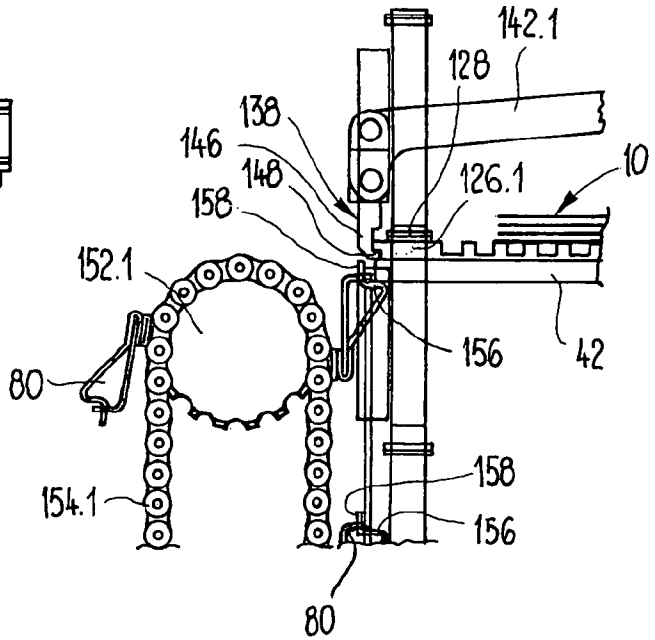
FIG. 4 is a side schematic view of an enlarged detail IV taken from the exemplary device shown in FIG. 3.

As shown in FIG. 4, the structures 128, with which corresponding toothed-belt drives can interact, may be provided on the upper side and/or a lower side of the set-down tables 42. If appropriate, a movement of the set-down tables 42 on a driving belt or a driving wheel by means of friction is also possible.

The toothed belt 124, including possible driving belts, are pressed against the set-down tables 42 to be moved in lateral positive-guiding means in the form of further U-shaped guide rails 100. The entire holding-ready section 76 is equipped with the guide rails 100, which may be manufactured from plastic.

For transferring the set-down tables 42 to the transfer section 32, the set-down tables 42 are initially moved forward via a further curvature 130 of the guide rails 100 in the circulating direction U by the table-holding-ready drive 120. Subsequently, the set-down tables 42 are conveyed by a lower strand 132 of a further toothed belt 134 of a horizontally oriented table drawing-in means 136 in a substantially jerk-free and jolt-free manner until the set-down tables 42 reach the set-down position 38. In the drawing-in process, the circulating toothed belt 134 again interacts with the engagement structure 128, which is formed on the upper side of the set-down table 42 on both sides in the edge regions 126.1, 126.2, to move the set-down table 42 forward. The typical duration for the drawing-in operation of a set-down table 42 by the table drawing-in means 136 is 0.4 s to 0.8 s.

In the transfer section 32, as shown in FIG. 4, guide rail sections 138 are located on both sides of the set-down table 42 and are designed in a manner such that the guide rail sections 138 can be switched freely. For this purpose, a linkage 140 includes two switching arms 142.1, 142.2 located above the transfer section 32, and a centrally arranged suspension means 144 vertically displaceable by means of a lifting magnet (not shown). In an upper position of the suspension means 144, as shown in FIG. 4 for the end region of the left switching arm 142.1, guide claws 146 engage in rectangular cross-sectional retaining grooves 148 formed laterally on the set-down tables 42. The retaining grooves 148 form the guide rail sections 138 for the set-down tables 42. In the case of a vertical displacement of the suspension means 144 downward, the guide claws 146 are folded away outward out of the retaining grooves 148. As a result, the set-down tables 42 rest freely on the side mounts 80 of the table-carrying bands 82 arranged on both sides of the set-down tables 42, lowered via a stepping motor 150 shown in FIG. 3, and connected via right-handed and left-handed worm drives to guide wheels 152.1, 152.2 of the table-carrying bands 82.

Figure 3:
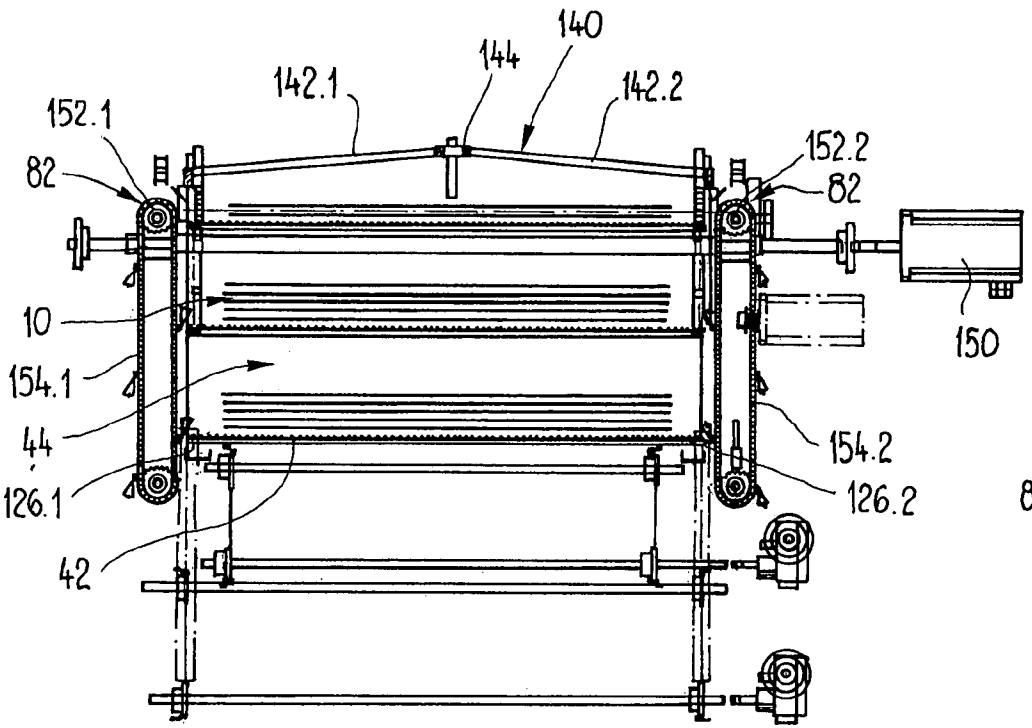
FIG. 3 is a front schematic view of the exemplary device shown in FIG. 1 for stacking paper products.

As shown in FIGS. 3 and 4, the table-carrying bands 82, which are arranged on both sides of the set-down tables 42 and circulate in opposite directions, are each equipped with chains 154.1, 154.2 to which the side mounts 80 are resiliently fastened. The side mounts 80, which extend over an entire side length of a set-down table 42 resting on a side mount 80, have a cross section that forms a substantially right-angled triangle. A side 156 of the side mounts 80 is located at the top during the lowering process to support the set-down table 42 on the side 156, and edges 158 are formed to protrude vertically upward to horizontally and laterally bound the positioning region of the set-down tables 42. The edges 158 may be used instead of the guide rails 100.

FIGS. 5*a*-5*d* are side schematic views of locations of the set-down tables of the paper stacker 14, which is shown in FIG. 1 to FIG. 4, at four different times. In this case, in contrast to the previous illustrations, only four set-down tables 42.1, 42.2, 42.3, 42.4 are located simultaneously in the table-circulating path 68. In each case six paper products 12, lying one above another, form a complete stack 10.

Figure 5A:
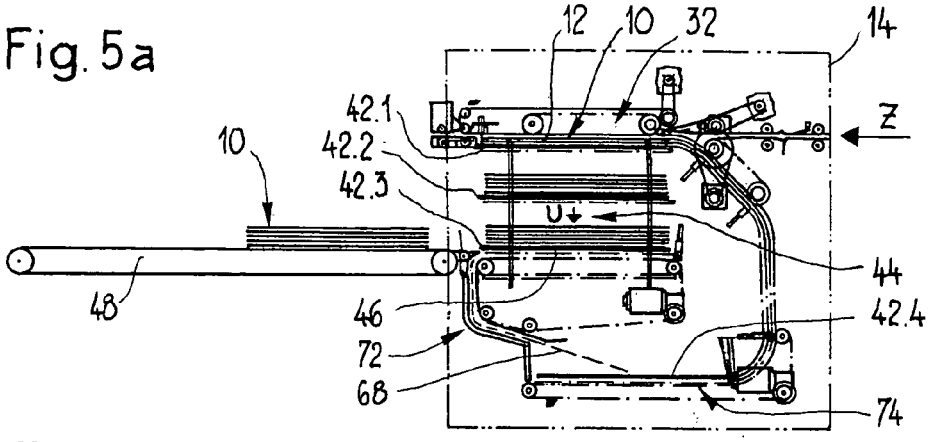
FIGS. 5*a*-5*d* are side schematic views of locations of the set-down table of the exemplary device shown in FIG. 1 for stacking paper products, at four different times.

FIG. 5*a* shows the paper stacker 14 when setting down a further paper product 12 on an existing, but not yet complete stack 10 in the transfer section 32. A set-down table 42.1 carrying the stack 10 is already located in the lowered state in the stacking section 44. Located under the set-down table 42.1, likewise in the stacking section 44, is a set-down table 42.2 loaded with a complete stack 10. Below the set-down table 42.2, a set-down table 42.3 is already located in the delivery section 46. A complete stack 10 that has previously been transported by a set-down table 42.4 to the delivery section 46, is shown on the removal conveyor 48. The set-down table 42.4 has already passed through the return section 72 and is located in the table store 74.

Figure 5B:
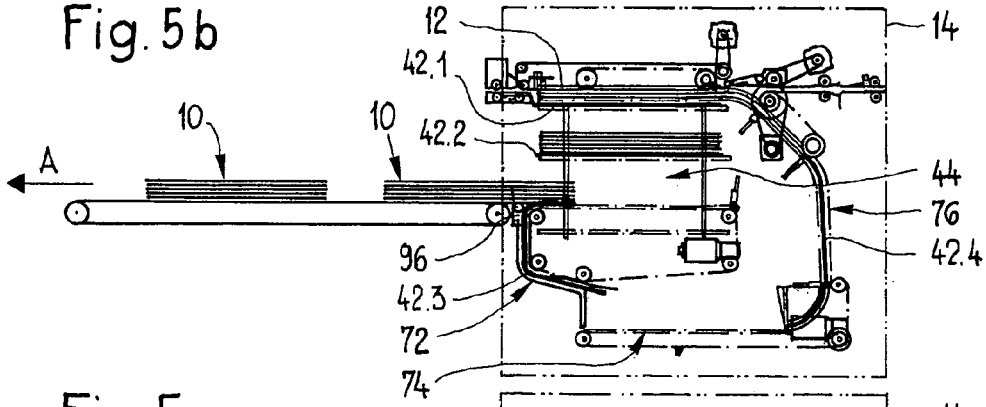

In a next phase shown in FIG. 5*b*, the set-down table 42.4 has left the table store 74 again and is already in the holding-ready section 76. The set-down table 42.1 located in the stacking section 44 has been lowered again, and the supported stack 10 already has a further paper product 12 set down on the stack 10. The set-down table 42.2 has also been lowered to the same extent as the set-down table 42.1. The set-down table 42.3 is deflected at the guide grid 96 into the return section 72 while the stack 10 supported by the set-down table 42.3 is pushed further horizontally in the removing direction A onto the removal conveyor 48.

Figure 5C:
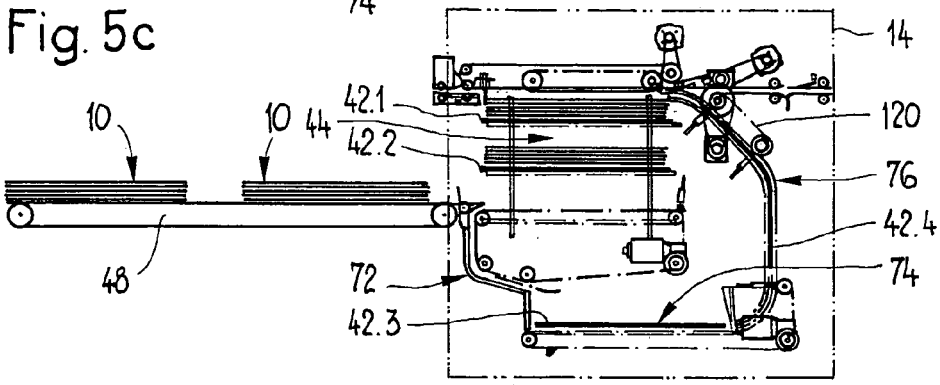

At the time illustrated in FIG. 5*c*, the set-down table 42.3 has already left the return section 72 and is located in the table store 74. The set-down table 42.4 is still located in the holding-ready section 76, as in the preceding phase, but has now already been grasped by the table-holding-ready drive 120. The set-down table 42.1 has already received the six paper products 12 and has already been lowered further in the stacking section 44 than is envisaged for receiving a further paper product 12. The removal conveyor 48 has completely taken over the stack 10, which is still shown on the set-down table 42.3 in FIG. 5*b*, and transports the stack 10 away.

Figure 5D:
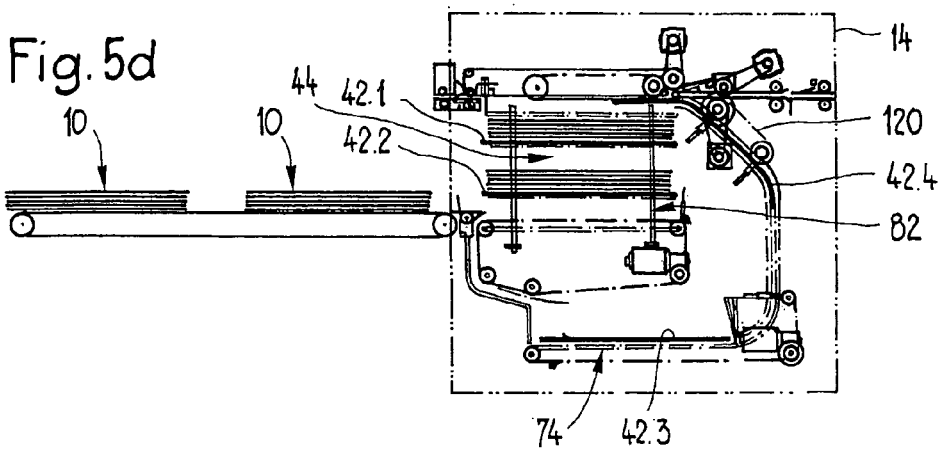

FIG. 5*d* illustrates a time shortly after the time illustrated in FIG. 5*c*. In this case, the set-down table 42.4 has already been partially displaced by the table-holding-ready drive 120 into the transfer section 32 and has been grasped by the table drawing-in means 136. Within a short time, the set-down table 42.4 may be released again by the guide claws 146 (FIG. 4) being folded away, for mounting at the side mounts 80 (FIG. 4) of the table-carrying bands 82. Therefore, the set-down table 42.4 may again be available for receiving a further stack 10. The set-down tables 44.1, 44.2 located in the stacking section 44 have only been lowered slightly further downward and the set-down table 44.3 is still located in the table store 74 as in the preceding phase.

The positions of the set-down tables 42 in the table-circulating path 68 are determined at all times by an electronic control device (not shown). Input signals are generated, in particular, by the sensors 90, 96, 118 in the paper stacker 14, by devices connected upstream or downstream, for example the rotational cutting device 16, by the optional additional unit 66, for example a continuing conveyor, and/or by an operator. The control device produces control and output signals for the electric motors 56, 64, 92, 114, 150 of the paper stacker 14, for devices connected upstream or downstream, for optional additional units 66, and/or for the operator, as a function of the input signals.

While various details have been described in conjunction with the exemplary embodiments outlined above, various alternatives, modifications, variations, improvements, and/or substantial equivalents, whether known or that are or may be presently unforeseen, may become apparent upon reviewing the foregoing disclosure. Accordingly, the exemplary embodiments set forth above are intended to be illustrative, not limiting.

What is claimed is:

1. A device for forming stacks of sheet products, the device comprising:

at least two set-down tables, each of the set-down tables including at least one set-down surface for receiving the stacks of the products;

a drive or transporting arrangement that moves the at least two set-down tables independently from one another along a single table-circulating path, wherein the table-circulating path comprises:

a transfer section to which the products are supplied in an input stream by a feed conveyor;

a stacking section arranged downstream of the transfer section and in which product stacks are formed on the set-down surfaces of the set-down tables;

a delivery section arranged downstream of the stacking section and from which the finished stacks are removed from the set-down tables by a removal conveyor; and a table store for intermediate storage and stacking of the set-down tables and subsequent release of the stored set-down tables for further circulation, the table store being arranged downstream of the delivery section, and wherein the set-down tables include flexible segments such that a shape of each of the set-down tables is configured to conform to curvatures of the table-circulating path, the curvatures being located at least in parts and subregions of the table-circulating path;

wherein the drive or transporting arrangement further includes: a first drive means located at a first location along the table-circulating path for selectively lowering one of the at least two set-down tables in the stacking section, a second drive means located at a second location along the table-circulating path for selectively engaging one of the at least two set-down tables in the delivery section, and a third drive means located at a third location along the table-circulating path for selectively engaging and transferring one of the at least two set-down tables from the table store to the stacking section, each of the drive means being independently driven.

2. The device according to claim 1, wherein in the stacking section the table-circulating path runs substantially rectilinearly, and the set-down tables are guided at least in a substantially horizontal orientation in the stacking section.

3. The device according to claim 2, further comprising side mounts arranged on counter-rotating table-carrying bands, the side mounts laterally engaging with the set-down tables to hold and lower the set-down tables in the stacking section.

4. The device according to claim 1, further comprising a comb-shape guide grid, wherein the table-circulating path in the region of the delivery section includes a first curvature of the curvatures, which is curved in the circulating direction from at least a substantially horizontal course to at least a substantially vertical course, and wherein the set-down tables pass through the first curvature to push the stacks of the products at least substantially horizontally onto the guide grid, which preferably engages the set-down tables.

5. The device according to claim 1, wherein, in a region located upstream of the delivery section, the table-circulating path is curved in the circulating direction from at least a substantially vertical course to at least a substantially horizontal course.

6. The device according to claim 1, wherein a total number of set-down tables in the table-circulating path are variable.

7. The device according to claim 1, wherein the set-down tables each include an engagement structure that may engage a guiding means to guide each of the set-down tables along the table-circulating path.

8. The device according to claim 7, wherein the engagement structure is formed at least in one edge region of each of the set-down tables, preferably in two edge regions, which are arranged opposite to each other and extend parallel to each other.

9. The device according to claim 7, wherein the engagement structure includes at least one of elevations and depressions that may engage the guiding means, the guiding means including a toothed belt.

10. The device according to claim 1, further comprising U-shaped guide rails that guide the set-down tables along lateral edge regions of the table-circulating path.

11. The device according to claim 1, further comprising a control device, preferably an electronic control device, which controls spatial and temporal distances of the set-down tables to determine positions of the set-down tables in the table-circulating path.

12. The device according to claim 11, wherein the control device is influenced by devices connected upstream or downstream.

13. The device according to claim 1, wherein the set-down tables each include a plurality of segments arranged such that the set-down tables are capable of bending in a first direction and are rigid in a direction opposite the first direction.

* * * * *